United States Patent [19]

Corsette

[11] 4,046,292

[45] Sept. 6, 1977

[54] MANUAL CONTAINER MOUNTED PUMP

[76] Inventor: Douglas F. Corsette, 6559 Firebrand St., Los Angeles, Calif. 90045

[21] Appl. No.: 719,234

[22] Filed: Aug. 31, 1976

[51] Int. Cl.[2] ..... B05B 11/00

[52] U.S. Cl. ..... 222/383; 239/333; 239/350

[58] Field of Search ..... 222/321, 383, 385, 499; 239/320, 321, 322, 333, 350

[56] References Cited

U.S. PATENT DOCUMENTS

| | | | |
|---|---|---|---|
| 3,257,961 | 6/1966 | Schlenker | 222/321 X |
| 3,379,381 | 4/1968 | Decaux | 222/385 X |
| 3,387,789 | 6/1968 | Fedit et al. | 222/321 X |
| 3,406,909 | 10/1968 | Pfeiffer | 222/321 X |
| 3,908,870 | 9/1975 | Nozawa et al. | 222/321 |

*Primary Examiner*—Robert B. Reeves
*Assistant Examiner*—David A. Scherbel
*Attorney, Agent, or Firm*—Watson, Cole, Grindle & Watson

[57] ABSTRACT

A dispensing pump of the type in which the outlet valve will open and will remain open only when the pumping pressure is maintained above a predetermined minimum. The pump cylinder in which the pump piston reciprocates, constitutes a unitary part of the outlet valve and also communicates freely with expansible, contractable pressure accumulation chamber, defined in part by the outlet valve and in part by the stationary pump housing. The pump piston and the outlet valve of the unit are movable independently of each other, while the stationary outlet or discharge passage for the pump is placed in communication with the pressure accumulation chamber only when the pressure within that chamber is at or above the predetermined minimum above referred to.

11 Claims, 1 Drawing Figure

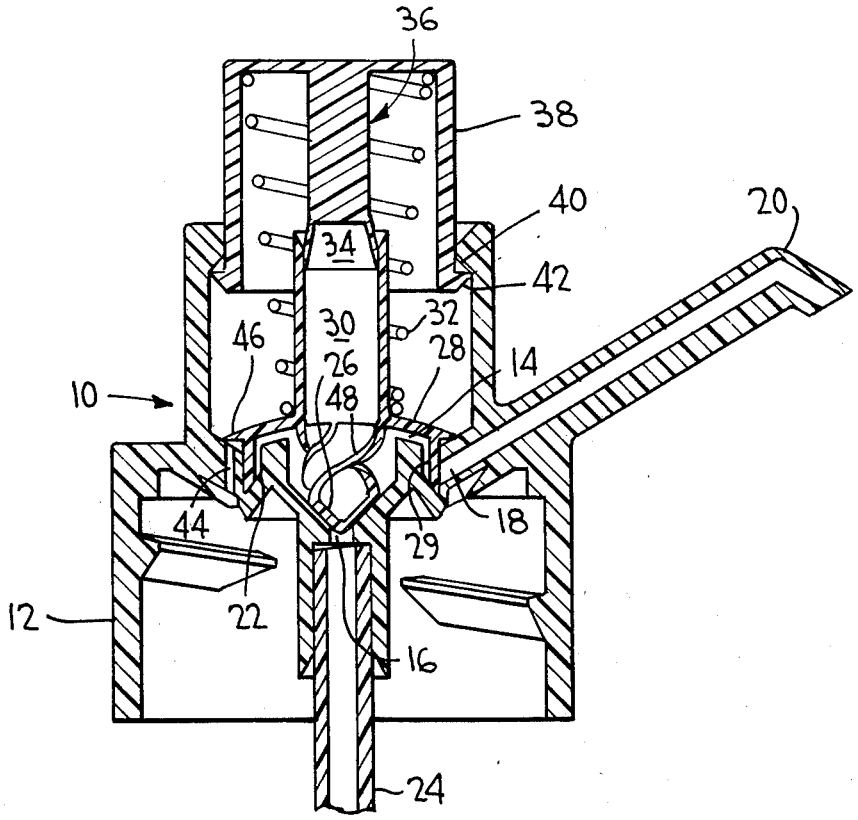
36
38
40
20
34
42
30
32
46
26
28
14
10
48
44
18
29
12
22
16
24

MANUAL CONTAINER MOUNTED PUMP

This invention relates to improvements in a dispensing pump of the class of which the pump cylinder communicates with and delivers liquid under pressure into a pressure accumulation chamber from which the discharge of pressurized product to the atmosphere is under the control of an outlet valve which permits discharge only when a predetermined minimum discharge pressure exists in the accumulation chamber.

Examples of such type of dispensing pump are disclosed in the following U.S. Pat. Nos. among others: KONDO — 3,761,022 and 3,921,861; NOZAWA — 3,908,870; BORIS — 3,746,260; STEVENS — 3,877,616.

In such prior patents the discharge or outlet passage extends through the reciprocable pump plunger or piston and the pump construction involves an appreciable number of components requiring to be separately fabricated and assembled.

The present invention is directed to a construction in which the discharge or outlet passage is formed in a stationary portion of the pump structure, namely the pump housing, and it is one of the objects of the present invention to reorganize the components of such type of pump so as to reduce and simplify the number of parts and the assembly thereof.

In addition it is an important feature of the invention to provide a substantially dripless product discharge, this being attained by an automatic low pressure cutoff at the end of each piston stroke. A further, more specific feature consists in supporting the intake valve from the outlet valve and the formation of both such valves and the inlet valve spring as an integrally molded plastic unit. According to a further feature, a unitary portion of the outlet valve functions as a vent valve for automatically opening and closing the vent passage.

Moreover, in the preferred embodiment of the invention, the entire valving system is arranged so as to be insensitive to gravity so that it will dispense flowable product in any position as long as proper communication is maintained between the product and the pump cylinder.

To broadly summarize the invention, the same comprises a pump housing, preferably constituting a part of and carried by the closure cap of a product container with which the pump is associated. The housing defines a cylindrical pressure accumulation chamber having an inlet port at one axial end for communication with the container and an outlet port opening radially from the accumulation chamber. An outlet valve is disposed in the accumulation chamber for axial movement from a closed position adjacent the said one axial end of the chamber, in which position it blocks communication between the inlet and outlet ports, to an open position remote from said one axial end, in which position it establishes communication between said inlet and outlet ports. The inlet valve is preferably supported from the outlet valve by a spring, the two valves and the spring comprising portions of a molded plastic valve unit. The pump cylinder is carried by and also constitutes an integral portion of the valve unit. The cylinder is in constant communication with the accumulation chamber through a central aperture of the outlet valve so that a pump piston, reciprocable in the cylinder independently of movement of the outlet valve, may be manually reciprocated to draw flowable product into the accumulation chamber, to thereafter compress it to a predetermined pressure sufficient to unseat the outlet valve. The outlet valve, inlet valve and the vent valve carried by the outlet valve are all normally biased toward seated position by a valve spring which encircles the pump chamber and is compressed between the outlet valve and the pump piston whereby to act also as a return spring for the latter, the return spring being located externally of all product chambers and channels to avoid corrosion and/or contamination of the product.

The preferred embodiment of the invention is illustrated in the accompanying FIGURE of drawing consisting of a cross sectional view in an axial plane of the cylindrical pump chamber, accumulation chamber and surrounding structure of the pump.

DETAILED DESCRIPTION OF THE SPECIFICATION

Referring now in detail to the accompanying drawing, the preferred dispensing pump of the invention includes a hollow housing 10 which is preferably mounted on and constitutes an integral portion of a container cap 12 adapted to support the pump on a container neck or spout in communication with the container interior. The cap, shown for purposes of exemplification has an internally threaded skirt exemplifying merely one of numerous ways of attaching the cap to the container. As will be noted the pump housing 10 defines a cylindrical pressure accumulation chamber 14 having an inlet port 16 at the lower axial end thereof for communication with the interior of the container or other source of flowable product to be dispensed. The outlet port 18 for the pump opens radially outwardly from said chamber through the cylindrical wall thereof and communicates with the atmosphere a discharge passage which in the present instance is defined by a discharge spout 20, although obviously the discharge passage may include a spray nozzle or other suitable form of discharge within the scope of the invention.

In the preferred form of the invention, the bottom end of the pressure accumulation chamber is formed to define an axially upward presented outlet valve seat 22 which desirably is of downwardly divergent conical configuration encircling the inlet port 16 in an annular zone extending between the inlet port and the outlet port 18. The inlet port 16 communicates with the flowable product in the container through a conventional dip-tube 24 in a manner well known in the art, and is controlled by an inlet check valve 26, which from a broad standpoint may be of conventional configuration, although in accordance with a particular feature of the invention, the inlet check valve illustrated is supported from and constitutes part of a unitary structure which also includes the outlet valve 28 and the pump cylinder 30.

The outlet valve 28 is of generally inverted cup-like configuration, having a depending cylindrical skirt 29 disposed for snug sliding axial movement in the cylindrical accumulation chamber 14 between a closed position adjacent the bottom or lower axial end of the chamber, in which position it blocks communication between the inlet and outlet ports 16, 18, and an open position remote from said lower end of the chamber in which it establishes communication between the inlet and outlet ports. Resilient means in the form of a return spring 32 normally urges the outlet valve toward its lower or closed position.

In this closed position, the lower end of the annular or cylindrical valve skirt 29 is conformed for axial sealing engagement with and seats against the annular valve seat 22 and, in addition, it extends across and closes the outlet port 18 through the cylindrical wall of the accumulation chamber. Though such a double sealing function is desirable, it will be apparent that it is essential only to have but one of the two types of seal, though in such case the sealing action or valving action may not be as efficient.

The pump cylinder 30 coaxial with the cylindrical outlet valve, is carried by and preferably constitutes a unitary portion of that valve, and is in constant communication with the accumulation or expansion chamber through the open lower end of the cylinder which coincides with the central aperture through the top wall of the outlet valve. Disposed for reciprocation in the pump cylinder 30 independently of the movement of the outlet valve 28, is a piston 34 at the lower end of a plunger 36, the upper end of which is conformed and adapted to receive intermittent finger pressure for operating the pump. The plunger includes a depending skirt 38 which is slidably guided and stabilized through an opening in the upper end of the housing 10, the housing having a radially inwardly directed annular flange 40 positioned for engagement with a radially outwardly directed flange 42 around the lower rim of the plunger skirt whereby to arrest the movement of the plunger in its fully raised position.

The same resilient means or spring 32 which actuates the unit comprising the inlet and outlet valves also is utilized as a return spring for the plunger and piston unit 34, 36. To this end it will be noted that the spring is of the coil type which encircles the cylinder and piston, and is compressed axially between the piston or plunger and the outlet valve. It is particularly noted that the return spring, as thus arranged, is located completely outside of the pump chambers and passages in a manner such as to be completely out of contact at all times with the liquid product being dispensed. The spring is thus not subject to corrosive action of the product or capable of contaminating the product in any way.

In accordance with a further feature of the invention, there is provided a vent passage 44 which extends through the lower axial end of the pump housing and/or container cap adjacent but exteriorly of the pressure accumulation chamber 14. The outlet valve 28 includes a radially outwardly projecting annular flange 46 which may advantageously be located so as to constitute a lateral extension of the top wall of the outlet valve, the flange extending radially to a location overlying the upper end of the vent passage and adapted to have its feathered radially outer edge or margin seated against the bottom wall of the housing when the outlet valve is in its lower or closed position. The flange 46, thus serves as a vent valve.

Although as earlier noted, any conventional check valve could be employed to control the inlet port 16, it is an important additional feature of the invention, that the check valve and its valve spring 48 both constitute portions of a unitary valve structure or unit which also includes the outlet valve 28, the venting valve 46 and the pump cylinder 30, so that a minimum number of parts are required for fabricating a pump in accordance with the invention. It will be noted that the pump comprises only three unitary portions or members aside from the return spring and dip-tube, these being the unitary valve member above referred to, the plunger unit 36 and the combined pump housing 10, spout 20 and container closure 12.

MODE OF OPERATION

In the operation of the invention, which is believed to be apparent from the foregoing, the pump piston is reciprocated by intermittent finger pressure on its upper end. It is of course returned to its fully raised position after each application of finger pressure by the return spring. When actuation of the pump is initiated, the outlet valve 28 will be urged to its closed position by the plunger return spring 32, while the inlet valve 26 will be seated over the inlet port 16 by the combined actions of the return spring 32 and the spring 48 which supports it from the outlet valve. Moreover, at this time the vent valve 46 will be seated against the bottom or lower end of the housing to seal the vent passage 44 from the atmosphere. As the downward piston stroke proceeds, any fluids contained within the pump cylinder 30 and accumulation chamber 14 will be compressed. When the degree of compression and the resulting upward force exerted on the outlet valve 28 is sufficient to raise that valve, it will fully or partially uncover the outlet port 18 while at the same time raising the lower edge of the valve skirt 29 from its seat 22, so as to place the outlet port 18 in communication with the accumulation chamber 14.

However, whenever the pressure within the accumulation chamber is reduced, either by reduced actuating force on the piston or through approach of the piston to the end of its downward stroke, so as to produce insufficient upward force to overpower the return spring 32, the spring will act to return the valve immediately to its closed position, thereby affording an abrupt sharp cut-off of the discharge to minimize dripping of product from the discharge spout 20.

On the succeeding upstroke of the piston under actuation of the return spring, the outlet valve 28 will remain seated to prevent back flow of fluid through the outlet port 18 into the accumulation chamber 14, while the resulting reduced pressure within the chamber and pump cylinder will open the inlet valve 26 against the action of its spring 48, thereby enabling a charge of flowable product from the container to be drawn upwardly through the dip-tube 24 and inlet port 16 into the intercommunicating accumulation chamber 14 and pump cylinder 30.

The outlet valve 28 will obviously remain closed throughout the entire upward stroke of the piston and, at or near the end of such upward stroke, the spring 48 will reseat the inlet valve over the inlet port in preparation for the next ensuing downstroke or compression stroke of the piston. On such stroke the action will be as heretofore. In other words the liquid product drawn into the accumulation chamber and pump cylinder on the previous upstroke will then be compressed to maintain a tight seating force or thrust against the inlet valve 26 and when the compression reaches a sufficient degree it will force the outlet valve 28 upwardly to unseat it from the annular outlet valve seat 22 while simultaneously uncovering the outlet port 18 to permit discharge of the product for as long as the pressure is maintained above the critical valve opening point. As soon as the pressure drops below that critical point, the outlet valve will immediately close.

Reciprocation of the pump piston may obviously be continued for as long as is necessary to dispense the desired amount of liquid from the container to which the pump is applied, following which the outlet valve will be automatically seated and sealed by the action of its return spring, while the inlet valve will similarly be urged immediately to seated position and retained in that position with respect to the inlet port, by action of its spring means.

Throughout the foregoing pumping or dispensing action, the vent valve 46 will automatically be opened simultaneously with unseating of the outlet valve, with the result that each time a charge of flowable product is delivered through the outlet port 18 to the atmosphere, the vent passage 44 is in open communication with the atmosphere through the clearance space between the plunger skirt 38, the housing 10 and the stop flanges 40, 42. Thus atmospheric air may be drawn into the container as necessary to replenish dispensed product, all as is well understood in the art.

It will be observed that in the instant embodiment it has been rendered possible to achieve a liquid dispenser of the pressure accumulation type having shipping seals for the vent passage, the inlet port and discharge ports all of which are automatically self-closing when the pump is at rest and between dispensing strokes. Moreover, it is made possible to provide such a dispenser of the pressure accumulating type which, unlike related prior art dispensers of the general type, utilizes a stationary discharge spout or passage which is rendered substantially dripless due to the sharp cutoff of discharge at the end of each dispensing stroke. The valving system throughout is manifestly insensitive to gravity to permit dispensing of the product in any position as long as the intake port is in communication with the product, either through a dip-tube or the equivalent or through inversion of the product container and pump.

Such a pump is adapted for fabrication from a minimum number of parts by a minimum number of assembly operations. In particular, it will be noted in the illustrated embodiment, the pump, including the container closure by which it is carried, is comprised of but three major unitary components, namely the pump housing, closure and spout unit 10, 12, 20, the pump piston unit 34, 36, 38, and the unit which defines the inlet, outlet and venting valves 26, 28 46. Each of these major unitary components is readily adapted for formation by usual plastic molding operations and, in order to complete the pump, it is necessary to add only the generally conventional standardized dip-tube 24 and the metal return spring 32, the latter being external to the product pumping chambers with the advantages earlier mentioned.

The several units and parts may readily be assembled simply by dropping the outlet valve unit 28, downwardly into the housing 10 through its open upper end, and inserting the return spring 32 downwardly over the upwardly projecting cylinder 30, following which the piston 34 may be inserted into the open upper end of the pump cylinder 30 and forced downwardly so that the radially outward flange 42 on its skirt is snapped past the cooperating internal snaprib or stop 40 within the upper end of the housing. The parts are obviously proportioned to facilitate such snap fitting, while limiting the normal upward movement of the piston at the end of each suction stroke.

Having thus described my invention, I claim:

1. A dispensing pump of the pressure accumulating type comprising;

a pump housing defining a cylindrical pressure accumulation chamber having in inlet port at one axial end thereof for communication with a source of flowable product to be dispensed, and an outlet port opening radially from said chamber;

an inlet check valve controlling said inlet port;

a centrally apertured outlet valve disposed for axial movement in said chamber from a closed position adjacent said one axial end of the chamber in which it blocks communication between said inlet and outlet ports to an open position remote from said one axial end in which it establishes communication between said inlet and outlet ports;

resilient means normally urging said outlet valve toward its closed position;

a pump cylinder carried by said outlet valve coaxially to said pressure accumulation chamber and in constant communication with said chamber through the central aperture of said valve;

a pump piston reciprocable in said cylinder independently of the movement of said outlet valve;

and means for manually reciprocating said piston.

2. A dispensing pump as defined in claim 1, in which said inlet check valve is carried by and resiliently supported from said outlet valve.

3. A dispensing pump as defined in claim 1, including an inlet valve spring compressed between said outlet valve and said inlet for biasing said inlet valve toward seated relation over said inlet port.

4. A dispensing pump as defined in claim 1, wherein said outlet valve and said pump cylinder are of unitary molded plastic construction.

5. A dispensing pump as defined in claim 3, in which said pump cylinder, said inlet and outlet valves and said inlet valve spring constitute a unitary plastic molding.

6. A dispensing pump as defined in claim 1, in which said resilient means normally urging said outlet valve toward its closed position comprises a coil spring encircling said pump cylinder and compressed axially between said pump piston and said outlet valve.

7. A dispensing pump as defined in claim 1, including a vent passage through said one axial end of the pump housing adjacent and exteriorly of said accumulation chamber, to establish communication between a container to which the pump is applied and the atmosphere, said outlet valve including a radially outwardly projecting flange having a portion positioned to seat over and seal the vent passage in the closed position of said outlet valve.

8. A dispensing pump as defined in claim 1, in which said outlet valve when closed covers and seals said outlet port.

9. A dispensing pump as defined in claim 1, in which said outlet valve when closed is in axial sealing engagement with said one axial end of the accumulation chamber throughout a zone encircling said inlet port.

10. A dispensing pump as defined in claim 1, in which said one axial end of the accumulation chamber is formed with an annular outlet valve seat surrounding said outlet port and said outlet valve includes an annular skirt conformed for axial sealing engagement with said annular outlet valve seat.

11. A dispensing pump as defined in claim 10, in which said annular outlet valve seat is of conical configuration diverging toward said one axial end of the accumulation chamber.

* * * * *